US011739983B1

(12) United States Patent
Jaber et al.

(10) Patent No.: US 11,739,983 B1
(45) Date of Patent: Aug. 29, 2023

(54) MODULATING GAS FURNACE AND ASSOCIATED METHOD OF CONTROL

(71) Applicant: Trane International Inc., Davidson, NC (US)

(72) Inventors: Youssef A Jaber, Tyler, TX (US); Wayne N Kraft, Tyler, TX (US)

(73) Assignee: Trane International Inc., Davidson, NC (US)

( * ) Notice: Subject to any disclaimer, the term of this patent is extended or adjusted under 35 U.S.C. 154(b) by 354 days.

(21) Appl. No.: 17/024,252

(22) Filed: Sep. 17, 2020

(51) Int. Cl.

| | |
|---|---|
| ***F24H 9/20*** | (2022.01) |
| ***F23L 17/00*** | (2006.01) |
| ***F23N 1/02*** | (2006.01) |
| ***F24D 5/04*** | (2006.01) |
| ***F23N 5/00*** | (2006.01) |
| ***F24H 3/06*** | (2022.01) |

(52) U.S. Cl.
CPC ..... *F24H 9/2085* (2013.01); *F23L 17/005* (2013.01); *F23N 1/022* (2013.01); *F23N 5/006* (2013.01); *F24D 5/04* (2013.01); *F24H 3/065* (2013.01); *F23N 2225/04* (2020.01); *F23N 2225/16* (2020.01); *F23N 2235/16* (2020.01)

(58) Field of Classification Search
USPC ..... 431/13
See application file for complete search history.

(56) References Cited

U.S. PATENT DOCUMENTS

| | | | |
|---|---|---|---|
| 4,251,025 | A | 2/1981 | Bonne et al. |
| 4,334,855 | A | 6/1982 | Nelson |
| 4,373,897 | A | 2/1983 | Torborg |
| 4,439,138 | A | 3/1984 | Craig et al. |
| 4,688,547 | A | 8/1987 | Ballard et al. |
| 5,307,990 | A | 5/1994 | Adams et al. |
| 5,407,990 | A | 4/1995 | Maeda et al. |
| 5,590,642 | A | 1/1997 | Borgeson et al. |
| 5,632,614 | A | 5/1997 | Consadori et al. |
| 5,860,411 | A | 1/1999 | Thompson et al. |
| 5,865,611 | A | 2/1999 | Maiello |
| 5,938,423 | A | 8/1999 | Nishiyama et al. |

(Continued)

FOREIGN PATENT DOCUMENTS

| | | |
|---|---|---|
| EP | 0 039 579 A1 | 4/1981 |
| WO | 2018/005366 A1 | 1/2018 |

*Primary Examiner* — Steven B McAllister
*Assistant Examiner* — John E Bargero
(74) *Attorney, Agent, or Firm* — Womble Bond Dickinson (US) LLP

(57) ABSTRACT

A method is provided for controlling combustion in a modulating gas furnace. The method includes receiving an indication of a firing rate setpoint for a burner assembly, and applying the firing rate setpoint to first and second continuous functions that map the firing rate setpoint to air-to-fuel ratio and combustion system pressure setpoints. A variable-speed draft inducer blower is set to drive to a combustion system pressure setpoint, and the modulating gas valve is controlled during combustion in the combustion system. In this regard, a combustion system pressure measurement is obtained and applied to an inverse of the first continuous function that outputs an adjusted firing rate for the combustion system pressure measurement. The adjusted firing rate is applied to a third continuous function that maps the firing rate to gas valve position, and outputs a gas valve position to which the modulating gas valve is set.

20 Claims, 8 Drawing Sheets

(56) References Cited

U.S. PATENT DOCUMENTS

| | | | | |
|---|---|---|---|---|
| 6,257,870 | B1 | 7/2001 | Hugghins et al. | |
| 6,283,115 | B1 | 9/2001 | Dempsey et al. | |
| 6,321,744 | B1 | 11/2001 | Dempsey et al. | |
| 6,866,202 | B2 | 3/2005 | Sigafus et al. | |
| 6,880,798 | B2 | 4/2005 | Meyer et al. | |
| 7,101,172 | B2 | 9/2006 | Jaeschke | |
| 7,293,718 | B2 | 11/2007 | Sigafus et al. | |
| 7,523,762 | B2 | 4/2009 | Buezis et al. | |
| 7,735,743 | B2 | 6/2010 | Jaeschke | |
| 7,985,066 | B2 | 7/2011 | Chian et al. | |
| 8,011,199 | B1 | 9/2011 | Chen et al. | |
| 8,123,518 | B2 | 2/2012 | Nordberg et al. | |
| 8,146,584 | B2 | 4/2012 | Thompson | |
| 8,167,610 | B2 | 5/2012 | Raleigh et al. | |
| 8,381,760 | B2 | 2/2013 | Santinanavat et al. | |
| 8,746,275 | B2 | 6/2014 | Santinanavat et al. | |
| 8,752,577 | B2 | 6/2014 | Santinanavat et al. | |
| 8,764,435 | B2 | 7/2014 | Nordberg et al. | |
| 8,813,776 | B2 | 8/2014 | Stark et al. | |
| 8,876,524 | B2 | 11/2014 | Schultz et al. | |
| 9,032,950 | B2 | 5/2015 | Schultz | |
| 9,038,658 | B2 | 5/2015 | Santinanavat et al. | |
| 9,071,183 | B2 | 6/2015 | Becerra et al. | |
| 9,121,628 | B2 | 9/2015 | Chen et al. | |
| 9,316,413 | B2 | 9/2016 | Nordberg et al. | |
| 9,453,648 | B2 | 9/2016 | Schultz et al. | |
| 9,581,331 | B2 | 2/2017 | Broker et al. | |
| 10,295,211 | B2 | 5/2019 | Perez et al. | |
| 10,337,747 | B2 | 7/2019 | Nordberg et al. | |
| 10,615,734 | B2 | 4/2020 | Oikawa et al. | |
| 10,775,053 | B2 | 9/2020 | Perez et al. | |
| 10,928,078 | B2 | 2/2021 | Hrejsa et al. | |
| 11,313,558 | B2 * | 4/2022 | Schlachter | F23N 5/184 |
| 2003/0059730 | A1 * | 3/2003 | Sigafus | F23N 5/203 431/18 |
| 2007/0238057 | A1 | 10/2007 | Specht | |
| 2009/0111065 | A1 * | 4/2009 | Tompkins | F23N 1/022 431/12 |
| 2010/0112500 | A1 | 5/2010 | Maiello et al. | |
| 2010/0179700 | A1 | 7/2010 | Lorenz et al. | |
| 2011/0162591 | A1 * | 7/2011 | Fan | F23N 5/006 122/14.21 |
| 2012/0279571 | A1 | 11/2012 | Santinanavat et al. | |
| 2012/0279584 | A1 | 11/2012 | Broker et al. | |
| 2012/0297819 | A1 | 11/2012 | Becerra et al. | |
| 2014/0231683 | A1 | 8/2014 | Broker et al. | |

* cited by examiner

MODULATING GAS FURNACE AND ASSOCIATED METHOD OF CONTROL

TECHNOLOGICAL FIELD

The present disclosure relates generally to control of modulating gas-fueled heating devices, and in particular, control of fuel and/or air in a gas-fueled heating device to maintain a desired heating capacity as well as emissions and efficiency targets.

BACKGROUND

Climate control systems, such as heating, ventilation, and/or air conditioning (HVAC) systems are used in residential and/or commercial areas to heat, cool or otherwise condition interior spaces. These systems often include a gas furnace with a burner assembly configured to combust fuel and air to create combustion gases that are forced through heat exchangers. The heat exchangers transfer heat from the combustion gases to air drawn across the exterior surface of the heat exchangers, thereby creating conditioned airflow for delivery to an interior space.

Combustion control in a gas furnace refers to the process of adjusting the flow of fuel and air to maintain desired heating capacity, emissions and efficiency targets, and many gas furnaces include a gas valve and a draft inducer blower for this purpose. The ratio between air and fuel where ideal combustion is said to be complete is called the Stoichiometric ratio. But in practice, controlling the air-to-fuel ratio to the Stoichiometric ratio can lead to unstable flame behavior, high temperature combustion and high carbon monoxide emissions. To prevent these undesirable effects, furnaces often run with some amount of excess air.

Traditionally, the desired air-to-fuel ratio is maintained using a pneumatic gas valve that has a pressure port connecting to the air stream created by the draft inducer blower, and a spring-loaded regulator that adjusts an opening for the passage of fuel through the valve. As the draft inducer blower creates more airflow, the pressure connected by the pressure port increases, which moves the spring-loaded regulator to open and thereby allows the passage of more fuel. The same design also decreases the amount of fuel flowing through the valve when less airflow is created. That way, the pneumatic gas valve maintains the air-to-fuel ratio at a desired level. This process can also be done electronically by measuring a pressure signal, and electronically actuating a gas valve to maintain a desired air-to-fuel ratio.

BRIEF SUMMARY

Controlling combustion using pressure feedback generally assumes consistency of parameters such as fuel components and heating value, oxygen content for a unit volume of air, and fuel flow rate for a given valve position. In practice, however, one or more of the parameters may not be consistent. The makeup of the fuel used can change for different installations and from time to time. This means that the heating capacity for a given amount of fuel and the combustion emissions can change even if other parameters are held constant. In that case, adjusting the gas valve opening based solely on sensed pressure may result in a deviation from the desired air-to-fuel ratio.

The oxygen content can also change independently or as a function of air density, which may also cause combustion behavior to deviate from its desired state, which may be particularly true for high altitude installations. Further, although the spring-loaded regulator of the pneumatic gas valve should map its position to a specific flow rate, this does not always hold when the gas line pressure entering the spring-loaded regulator changes by a significant amount.

Existing solutions to the issues discussed above compromise on capacity and targeted efficiency. They also require that an installer manually modify certain parameters depending on the installation or based on test results carried out on-site. Example implementations of the present disclosure provide a gas furnace, and in particular, a modulating gas furnace, and a method of control that takes into account at least some of these issues, as well as other possible issues.

In particular, example implementations of the present disclosure provide a modulating gas furnace and method of control that assume a correlation between the air-to-fuel ratio and the square root of the ratio of combustion system pressure to valve position. That assumption is used to move the gas valve in response to a measured system pressure to maintain a targeted air-to-fuel ratio. In addition, the algorithm includes a process to recalibrate that correlation at steady state using feedback from a temperature sensor or a difference between two temperature sensor readings. This allows the controller to account for variations in line pressure, fuel components, air density and oxygen concentration.

The present disclosure thus includes, without limitation, the following example implementations.

Some example implementations provide a modulating gas furnace comprising a combustion system that includes a burner assembly; a variable-speed draft inducer blower configured to move air through the combustion system; a modulating gas valve configured to modulate an amount of fuel delivered to the burner assembly; a pressure sensor configured to measure combustion system pressure; and control circuitry operably coupled to the variable-speed draft inducer blower, the modulating gas valve and the pressure sensor, the control circuitry configured to at least: receive an indication of a firing rate setpoint for the burner assembly; apply the firing rate setpoint to a first continuous function and a second continuous function that map the firing rate setpoint to an air-to-fuel ratio setpoint and a combustion system pressure setpoint, the first continuous function mapping firing rate to combustion system pressure; set the variable-speed draft inducer blower to drive to the combustion system pressure setpoint; and control the modulating gas valve during combustion in the combustion system, including the control circuitry configured to at least: obtain a combustion system pressure measurement from the pressure sensor; apply the combustion system pressure measurement to an inverse of the first continuous function that outputs an adjusted firing rate for the combustion system pressure measurement; apply the adjusted firing rate to a third continuous function that maps the firing rate to gas valve position, and outputs a gas valve position for the adjusted firing rate; and set the modulating gas valve to the gas valve position.

In some example implementations of the modulating gas furnace of any preceding example implementation, or any combination of any preceding example implementations, the control circuitry is configured to control the modulating gas valve continuously during combustion in the combustion system.

In some example implementations of the modulating gas furnace of any preceding example implementation, or any combination of any preceding example implementations, the first continuous function, the second continuous function and the third continuous function are defined by equations that include terms determined during calibration of the modulating gas furnace at calibration points with calibration firing rates that define endpoints of firing rate ranges for which the terms have respective values, and wherein the control circuitry is configured to apply the firing rate setpoint to the first continuous function and the second continuous function, and apply the adjusted firing rate to the third continuous function, in which the terms are set to the respective values for one of the firing rate ranges that includes the firing rate setpoint.

In some example implementations of the modulating gas furnace of any preceding example implementation, or any combination of any preceding example implementations, the modulating gas furnace further comprises an oxygen sensor configured to measure oxygen concentration in the air moved through the combustion system, and wherein the control circuitry configured to control the modulating gas valve further includes the control circuitry configured to at least: obtain an oxygen concentration measurement from the oxygen sensor; determine an air-to-fuel ratio measurement from the oxygen concentration measurement; determine a gas valve position adjustment based on a difference between the air-to-fuel ratio setpoint and the air-to-fuel ratio measurement; and modify the gas valve position with the gas valve position adjustment.

In some example implementations of the modulating gas furnace of any preceding example implementation, or any combination of any preceding example implementations, the control circuitry configured to determine the gas valve position adjustment includes the control circuitry configured to bound the gas valve position adjustment to a maximum adjustment.

In some example implementations of the modulating gas furnace of any preceding example implementation, or any combination of any preceding example implementations, the modulating gas furnace further comprises a temperature sensor configured to measure temperature inside the combustion system, and wherein at least the first continuous function and the second continuous function are defined by equations that include terms determined during calibration of the modulating gas furnace at calibration points with calibration firing rates and calibrated temperatures, and the control circuitry configured to control the modulating gas valve further includes the control circuitry configured to at least: detect a steady-state operation of the modulating gas furnace at the firing rate setpoint or the adjusted firing rate; obtain a temperature measurement from the temperature sensor; determine a gas valve position adjustment based on a difference between at least one of the calibrated temperatures and the temperature measurement; and modify the gas valve position with the gas valve position adjustment.

In some example implementations of the modulating gas furnace of any preceding example implementation, or any combination of any preceding example implementations, the control circuitry is configured to detect the steady-state operation of the modulating gas furnace at the firing rate setpoint or the adjusted firing rate that corresponds to a calibration firing rate for a calibration point, and the control circuitry is configured to determine the gas valve position adjustment based on a difference between a calibrated temperature for the calibration point, and the temperature measurement.

In some example implementations of the modulating gas furnace of any preceding example implementation, or any combination of any preceding example implementations, the control circuitry is configured to detect the steady-state operation of the modulating gas furnace at the firing rate setpoint or the adjusted firing rate that is between the calibration firing rates for consecutive calibration points, and the control circuitry is configured to determine the gas valve position adjustment based on differences between the calibrated temperatures for the consecutive calibration points, and the temperature measurement.

In some example implementations of the modulating gas furnace of any preceding example implementation, or any combination of any preceding example implementations, the control circuitry configured to determine the gas valve position adjustment includes the control circuitry configured to bound the gas valve position adjustment to a maximum adjustment.

In some example implementations of the modulating gas furnace of any preceding example implementation, or any combination of any preceding example implementations, the modulating gas furnace further comprises a heat exchanger assembly; and a variable-speed circulating air blower configured to create an airflow to which heat from the heat exchanger assembly is transferred to create a conditioned airflow, and wherein the control circuitry is further configured to at least: receive an indication of a selected temperature rise desired for the conditioned airflow, and in the selected temperature rise is a desired difference in temperature between air entering and exiting the heat exchanger assembly; apply the firing rate setpoint and the selected temperature rise to a fourth continuous function that maps firing rate and temperature rise to airflow rate, and that outputs an airflow rate setpoint for the firing rate setpoint and the selected temperature rise; and set the variable-speed circulating air blower to drive to the airflow rate setpoint.

Some example implementations provide a method of controlling combustion in a modulating gas furnace that includes a variable-speed draft inducer blower configured to move air through a combustion system that includes a burner assembly, a modulating gas valve configured to modulate an amount of fuel delivered to the burner assembly, and a pressure sensor configured to measure combustion system pressure, the method comprising receiving an indication of a firing rate setpoint for the burner assembly; applying the firing rate setpoint to a first continuous function and a second continuous function that map the firing rate setpoint to an air-to-fuel ratio setpoint and a combustion system pressure setpoint, the first continuous function mapping firing rate to combustion system pressure; setting the variable-speed draft inducer blower to drive to the combustion system pressure setpoint; and controlling the modulating gas valve during combustion in the combustion system, including: obtaining a combustion system pressure measurement from the pressure sensor; applying the combustion system pressure measurement to an inverse of the first continuous function that outputs an adjusted firing rate for the combustion system pressure measurement; applying the adjusted firing rate to a third continuous function that maps the firing rate to gas valve position, and outputs a gas valve position for the adjusted firing rate; and setting the modulating gas valve to the gas valve position.

In some example implementations of the method of any preceding example implementation, or any combination of any preceding example implementations, control of the modulating gas valve is performed continuously during combustion in the combustion system.

In some example implementations of the method of any preceding example implementation, or any combination of any preceding example implementations, the first continuous function, the second continuous function and the third continuous function are defined by equations that include terms determined during calibration of the modulating gas furnace at calibration points with calibration firing rates that define endpoints of firing rate ranges for which the terms have respective values, and wherein the firing rate setpoint is applied to the first continuous function and the second continuous function, and the adjusted firing rate is applied to the third continuous function, in which the terms are set to the respective values for one of the firing rate ranges that includes the firing rate setpoint.

In some example implementations of the method of any preceding example implementation, or any combination of any preceding example implementations, the modulating gas furnace further includes an oxygen sensor configured to measure oxygen concentration in the air moved through the combustion system, and controlling the modulating gas valve further includes: obtaining an oxygen concentration measurement from the oxygen sensor; determining an air-to-fuel ratio measurement from the oxygen concentration measurement; determining a gas valve position adjustment based on a difference between the air-to-fuel ratio setpoint and the air-to-fuel ratio measurement; and modifying the gas valve position with the gas valve position adjustment.

In some example implementations of the method of any preceding example implementation, or any combination of any preceding example implementations, determining the gas valve position adjustment includes bounding the gas valve position adjustment to a maximum adjustment.

In some example implementations of the method of any preceding example implementation, or any combination of any preceding example implementations, the modulating gas furnace further includes a temperature sensor configured to measure temperature inside the combustion system, at least the first continuous function and the second continuous function are defined by equations that include terms determined during calibration of the modulating gas furnace at calibration points with calibration firing rates and calibrated temperatures, and controlling the modulating gas valve further includes: detecting a steady-state operation of the modulating gas furnace at the firing rate setpoint or the adjusted firing rate; obtaining a temperature measurement from the temperature sensor; determining a gas valve position adjustment based on a difference between at least one of the calibrated temperatures and the temperature measurement; and modifying the gas valve position with the gas valve position adjustment.

In some example implementations of the method of any preceding example implementation, or any combination of any preceding example implementations, the steady-state operation of the modulating gas furnace is detected at the firing rate setpoint or the adjusted firing rate that corresponds to a calibration firing rate for a calibration point, and the gas valve position adjustment is determined based on a difference between a calibrated temperature for the calibration point, and the temperature measurement.

In some example implementations of the method of any preceding example implementation, or any combination of any preceding example implementations, the steady-state operation of the modulating gas furnace is detected at the firing rate setpoint or the adjusted firing rate that is between the calibration firing rates for consecutive calibration points, and the gas valve position adjustment is determined based on differences between the calibrated temperatures for the consecutive calibration points, and the temperature measurement.

In some example implementations of the method of any preceding example implementation, or any combination of any preceding example implementations, determining the gas valve position adjustment includes bounding the gas valve position adjustment to a maximum adjustment.

In some example implementations of the method of any preceding example implementation, or any combination of any preceding example implementations, the modulating gas furnace further includes with a heat exchanger assembly, and a variable-speed circulating air blower configured to create an airflow to which heat from the heat exchanger assembly is transferred to create a conditioned airflow, and the method further comprises receiving an indication of a selected temperature rise desired for the conditioned airflow, and in the selected temperature rise is a desired difference in temperature between air entering and exiting the heat exchanger assembly; applying the firing rate setpoint and the selected temperature rise to a fourth continuous function that maps firing rate and temperature rise to airflow rate, and that outputs an airflow rate setpoint for the firing rate setpoint and the selected temperature rise; and setting the variable-speed circulating air blower to drive to the airflow rate setpoint.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURE(S)

Having thus described example implementations of the disclosure in general terms, reference will now be made to the accompanying figures, which are not necessarily drawn to scale, and wherein:

DETAILED DESCRIPTION

Figure 1:
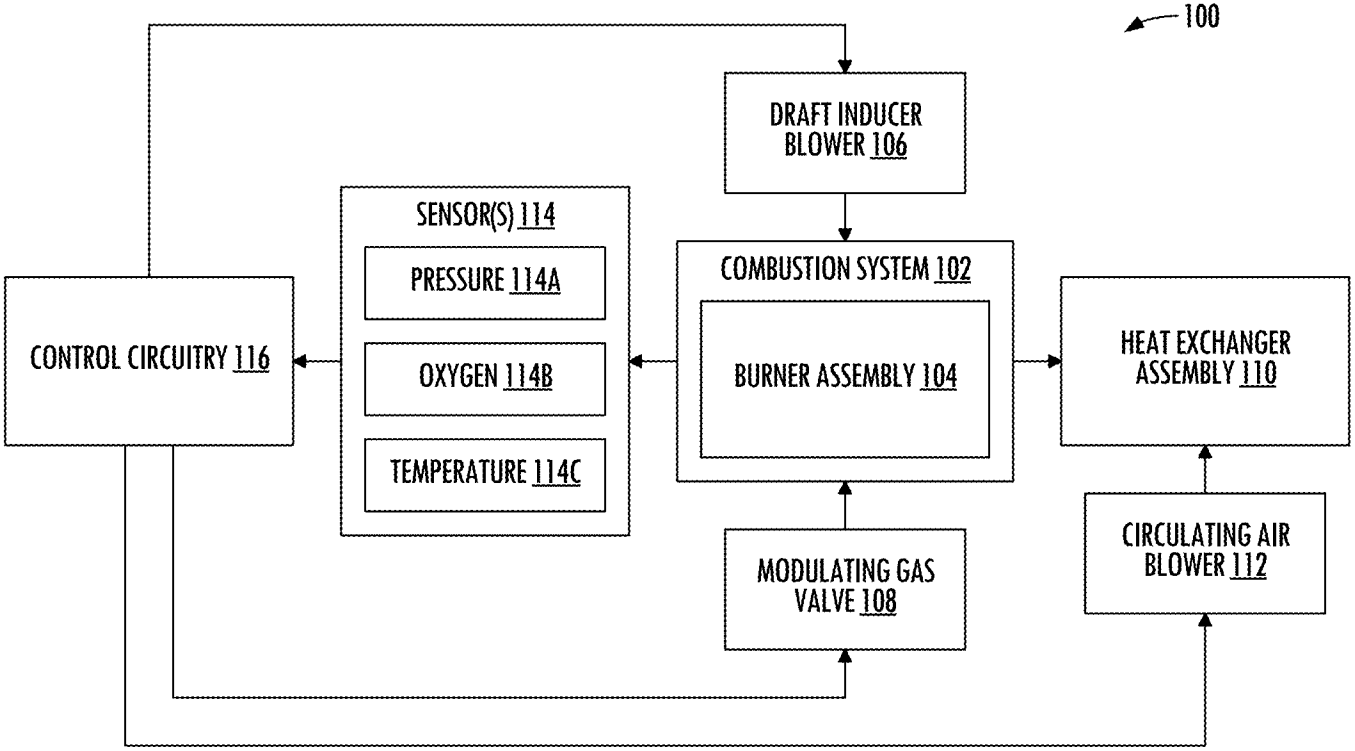
FIG. 1 is a block diagram of a modulating gas furnace according to some example implementations of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," "observation" and similar terms may be at times used interchangeably.

Example implementations of the present disclosure relate generally to control of modulating gas-fueled heating devices, and in particular, control of fuel and/or air in a gas-fueled heating device to maintain a desired heating capacity as well as emissions and efficiency targets. Example implementations will be primarily described in conjunction with gas furnaces used in HVAC applications, but it should be understood that example implementations may be utilized in conjunction with a variety of other applications. Examples of other suitable gas-fueled heating devices that may benefit from example implementations include water heaters, kitchen appliances, boilers, and the like.

As discussed herein, a gas or gas-fueled furnace refers to a furnace configured to be in fluid communication with a gas flow for thermodynamic heat transfer, and in which the gas flow includes products of a combustion reaction from a burner. In some examples, the gas furnace may be a component part of an HVAC system that includes an indoor unit with the gas furnace and an indoor refrigerant heat exchanger or evaporator, an outdoor unit with an outdoor fan and an outdoor refrigerant heat exchanger or condenser, and a refrigerant loop extending between the indoor and outdoor refrigerant heat exchangers. The gas furnace may be configured as an indoor furnace that provides conditioned fluid, often air, to a comfort zone of an indoor space. In general, however, components of the gas furnace may be equally employed in an outdoor or weatherized furnace to condition an interior space. Moreover, the gas furnace may be used in residential or commercial applications.

FIG. 1 is a block diagram of a modulating gas furnace 100 according to some example implementations of the present disclosure. As used herein, the term "modulating" is meant to indicate that a system or device is selectively operable at substantially any value over a range of performance values in a manner consistent with a control resolution of the system or device. Generally, the modulating gas furnace is operable so that the modulating gas furnace may selectively perform at substantially any selected output capacity value (kBtu/Hr) ranging from a maximum output capacity (100% output capacity) to a minimum output capacity (e.g., 40% of the maximum output capacity). As described herein, the output capacity of the modulating gas furnace may correspond to a firing rate; and accordingly, the terms output capacity and firing rate may at times be used interchangeably.

The modulating gas furnace 100 includes a combustion system 102 with a burner assembly 104; and in some examples, the combustion system is a modulating combustion system capable of being constantly operated over a range of output capacities. The modulating gas furnace also includes a variable-speed draft inducer blower 106 and a modulating gas valve 108. The variable-speed draft inducer blower may be operated at many speeds over one or more ranges of speeds. The variable-speed draft inducer blower is configured to move air through the combustion system, and the modulating gas valve is configured to modulate an amount of fuel delivered to the burner assembly. In some examples, the modulating gas furnace further includes a heat exchanger assembly 110, and a variable-speed circulating air blower 112 configured to create an airflow to which heat from the heat exchanger assembly is transferred to create a conditioned airflow. Similar to the variable-speed draft inducer blower, the variable-speed circulating air blower may be operated at many speeds over one or more ranges of speeds.

The modulating gas furnace 100 includes one or more sensors 114 configured to measure one or more operating conditions of the modulating furnace. One example of a suitable sensor is a pressure sensor 114A configured to measure combustion system pressure. Another example of a suitable sensor is an oxygen sensor 114B configured to measure oxygen concentration in the air moved through the combustion system 102. And yet another example of a suitable sensor is a temperature sensor 114C configured to measure temperature inside the combustion system. Examples of suitable temperature sensors include thermocouples, resistor temperature detectors (RTDs), thermistors, infrared sensors, semiconductor-based integrated circuits (ICs), thermometers and the like.

As also shown, the modulating gas furnace includes control circuitry 116 that is generally configured to control operation of the modulating gas furnace 100. The control circuitry is operably coupled to the variable-speed draft inducer blower 106, the modulating gas valve 108 and the one or more sensors 114; and in some examples, the control circuitry is also operably coupled to the variable-speed circulating air blower 112.

According to some example implementations, the control circuitry 116 is configured to set the variable-speed draft inducer blower 106 to move a variable amount of air through the combustion system 102, and set the modulating gas valve 108 to allow delivery of a variable amount of fuel to the combustion system. The control circuitry may also be configured to set the variable-speed circulating air blower 112 to create a variable amount of airflow to which heat from the heat exchanger assembly 110 is transferred to create the conditioned airflow. In some examples, the control circuitry is responsive to conditions measured by the one or more sensors 114. The control circuitry may also be responsive to one or more other components such as a thermostat.

Figure 2A:
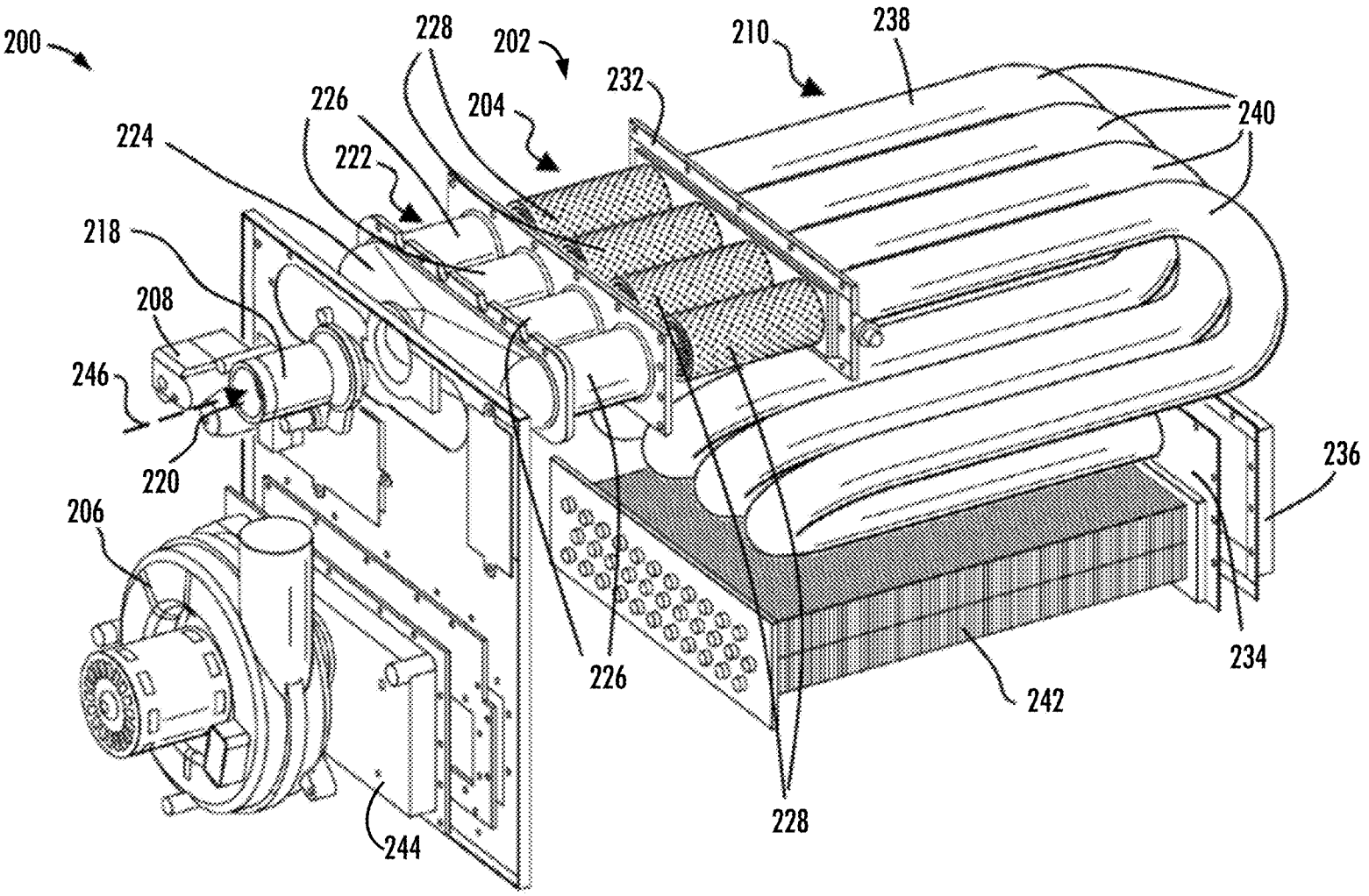
FIGS. 2A and 2B illustrate a modulating gas furnace that may correspond to the modulating gas furnace of FIG. 1, according to some example implementations.
Figure 2B:
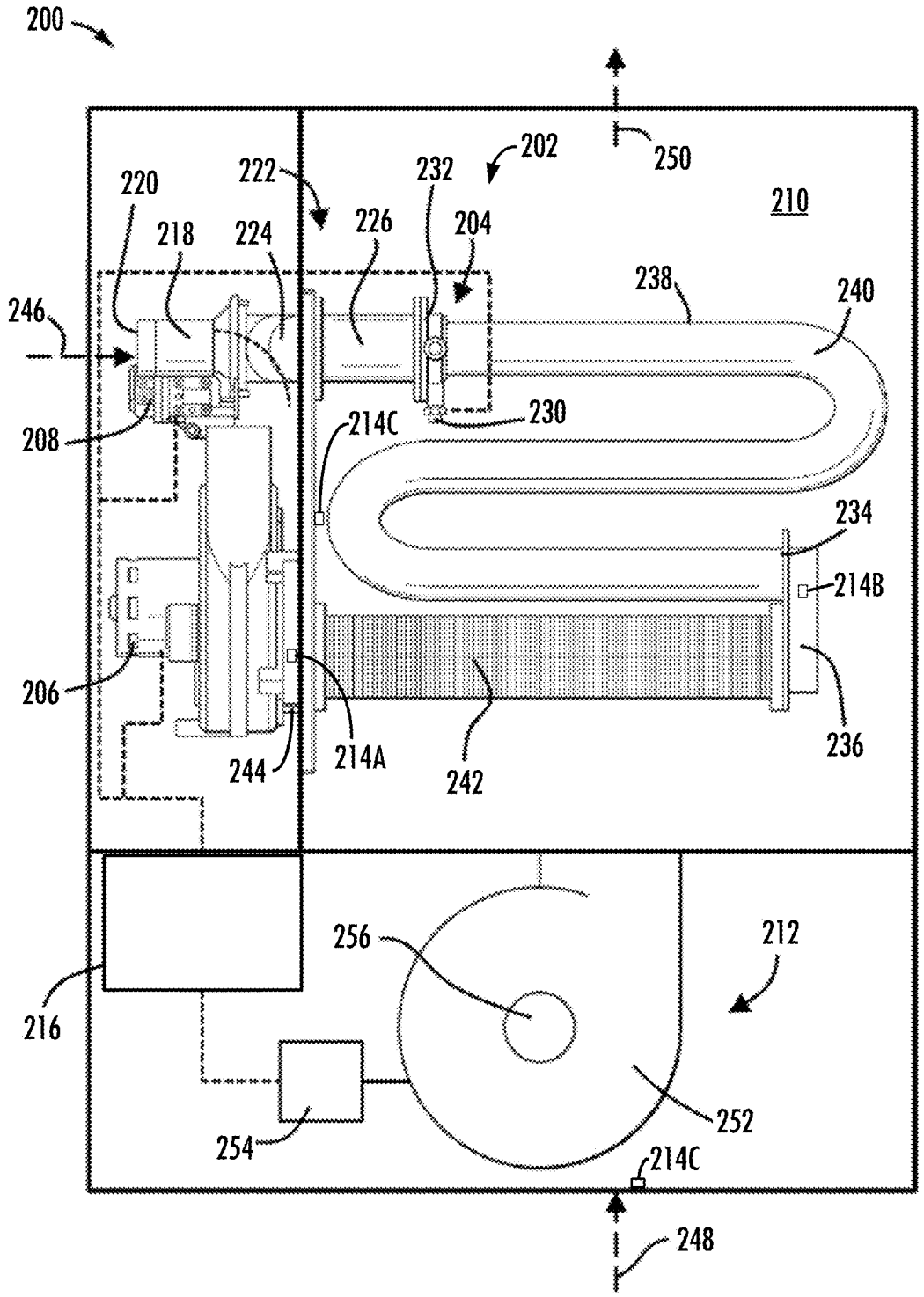

FIGS. 2A and 2B illustrate a modulating gas furnace 200 that in some example implementations may correspond to the modulating gas furnace 100. As shown, the modulating gas furnace 200 includes a combustion system 202 with a burner assembly 204, which may correspond to respective ones of the combustion system 102 and burner assembly 104. The modulating gas furnace 200 also includes a variable-speed draft inducer blower 206, a modulating gas valve 208, a heat exchanger assembly 210, and a variable-speed circulating air blower 212 (FIG. 2B), which may correspond to respective ones of the variable-speed draft inducer blower 106, the modulating gas valve 108, the heat exchanger assembly 110, and the variable-speed circulating air blower 112. The modulating gas furnace also includes one or more sensors that may correspond to the one or more sensors 114, and control circuitry 216 that may correspond to the control circuitry 116. These may include, for example, a pressure sensor 214A, an oxygen sensor 214B and/or a temperature sensor 214C.

As more particularly shown in FIGS. 2A and 2B, the modulating gas furnace 200 may include an air and fuel (air/fuel) mixing unit 218 configured for the introduction of fuel and air to allow at least partial mixing of fuel and air before a combustion reaction process. In other examples, the furnace may forego the air/fuel mixing unit and instead mix the fuel and air within the burner assembly 204. In examples including the air/fuel mixing unit, it may receive air via an air inlet 220 and fuel via the modulating gas valve 208 to allow at least partial mixing of the fuel and air. For example, the fuel may be natural gas, heating oil, or other fuels available from the modulating gas valve. The modulating gas valve may be electrically or pneumatically adjustable so as to obtain a desired and/or predefined air-to-fuel ratio. The modulating gas valve may be operably coupled to the control circuitry 216.

The modulating gas furnace 200 may include an intake manifold 222 with a flow distributor 224 extending from an inlet of the intake manifold coupled with the air/fuel mixing unit 218. The intake manifold may also include a plurality of heat exchanger supply tubes 226 extending from the flow distributor to an outlet of the intake manifold coupled with the heat exchanger assembly 210.

The burner assembly 204 of the modulating gas furnace 200 may include a plurality of burners 228 and at least one igniter 230. Each burner of the burner assembly may be received in one of the supply tubes 226 of the intake manifold 222. The igniter may be positioned at an opening of each burner and may be configured to induce a combustion reaction by igniting a gas flow passing in and/or by the burners, where the gas flow includes a mixture of the air and fuel. Particularly, the gas flow may initially take the form of air and fuel that is at least partially mixed and/or uncombusted (i.e., not yet ignited or undergone a combustion reaction) in air/fuel mixing unit 218. In some example implementations, the igniter may include any of a pilot light, a piezoelectric device, and/or a hot surface igniter. The igniter may be controlled by the control circuitry 216.

In some example implementations, the heat exchanger assembly 210 has a first end 232 coupled to the intake manifold 222, and a second end 234 coupled to a hot collector box 236. The heat exchanger assembly may include an exterior surface 238 and a plurality of heat exchanger tubes 240 extending between the first end and the second end. In some example implementations, a finned condensing heat exchanger 242 may extend from the hot collector box to a cold collector box 244 coupled to the variable-speed draft inducer blower 206. In this regard, the modulating gas furnace 200 may be operated with or without a condensing heat exchanger as a "condensing" or "non-condensing" furnace, respectively.

As the gas flow travels through the intake manifold 222 and the heat exchanger assembly 210, the burners 228 and the igniter 230 of the burner assembly 204 may initiate a combustion reaction. Combustion may occur at least partially within an interior space of each burner so that heat is generated and forced out of the open end of the burner and into the heat exchanger tube 240 of the heat exchanger assembly.

In some example implementations, the gas flow may follow a combustion flow path (indicated by arrow 246) that may be in a direction beginning at the air/fuel mixing unit 218 and ending at the variable-speed draft inducer blower 206. For example, the combustion flow path may follow from the air/fuel mixing unit, through the intake manifold 222, past the burners 228 and through the heat exchanger tubes 240 of the heat exchanger assembly 210. The combustion flow path may continue through the hot collector box 236, the condensing heat exchanger 242 and the cold collector box 244, and may exit past the variable-speed draft inducer blower towards a designated venting environment (not shown). It is understood that there may be more or less components of the modulating gas furnace 200 in fluid communication with the combustion flow path.

In some example implementations, the gas flow described above may be introduced into the modulating gas furnace 200 by operating in an induced draft mode by pulling the gas flow through the modulating gas furnace via the variable-speed draft inducer blower 206, or by operating in a forced draft mode by pushing the gas flow through the modulating gas furnace. The variable-speed draft inducer blower may include a blower or fan which is in fluid communication with combustion flow path 246 and is down-stream of the heat exchanger assembly 210. The variable-speed draft inducer blower may pull and/or extract the gas flow out from heat exchanger assembly by creating a relatively lower pressure at one end of the combustion flow path. Example implementations using a forced draft mode may be accomplished by placing a blower or fan at the inlet of the air/fuel mixing unit 218 and forcing the gas flow into and through the air/fuel mixing unit and along the combustion flow path.

As shown particularly in FIGS. 2A and 2B, the modulating gas furnace 200 may be disposed in a configuration such that fluids (e.g. air) that contact an exterior surface of a component of the modulating gas furnace (e.g. air passing over the exterior surface 238 of the heat exchanger assembly 210 for thermodynamic heat transfer) are segregated from the gas flow circulating along the combustion flow path 246.

The variable-speed circulating air blower 212 of the modulating gas furnace 200 may be configured to receive an inlet airflow 248 via a return air duct, and force or drive the inlet airflow into contact with the exterior surface 238 of heat exchanger assembly 210. In other example implementations, variable-speed circulating air blower may draw the airflow across the exterior surface of heat exchanger assembly. In response to the inlet airflow contacting the heat exchanger assembly, heat may be transferred from the gas flow circulating within heat exchanger assembly to the inlet airflow, thereby heating the inlet airflow. Following contact with heat exchanger assembly, the airflow may exit the modulating gas furnace as an outlet or conditioned airflow 250, which may have a temperature that is greater than a temperature of the inlet airflow. The conditioned airflow may be delivered to a comfort zone of an indoor space.

In some example implementations, the variable-speed circulating air blower 212 may include a centrifugal blower with a blower housing 252, and a blower motor 254 configured to selectively rotate a blower impeller 256 of the variable-speed circulating air blower that is at least partially disposed within blower housing. In other example implementations, the variable-speed circulating air blower may include a mixed-flow fan and/or any other suitable type of fan.

The modulating gas furnace 200 may include the control circuitry 216 to control one or more components of the modulating gas furnace. The control circuitry is operably coupled to various components of the modulating gas furnace as well as various sensors configured to measure one or more operating conditions of the modulating furnace. These sensors may include the pressure sensor 214A, oxygen sensor 214B and/or temperature sensor 214C. The pressure sensor may be positioned in the combustion flow path 246 downstream of the burners 228, and configured to measure combustion system pressure.

More particularly, for example, the pressure sensor 214A may be positioned at the hot collector box 236, the cold collector box 244 (shown), the variable-speed draft inducer blower 206, or the designated venting environment through which the combustion flow path exits the modulating gas furnace. In some examples, the combustion system pressure is a differential pressure between ambient air pressure in the intake manifold 222 (where the burners 228 are located) and pressure downstream of combustion in the combustion flow path 246. This downstream pressure may be the result of pressure losses as combustion products move through the combustion system 202.

The oxygen sensor 214B may be positioned similar to the pressure sensor 214A, and configured to measure oxygen concentration in the air moved through the combustion system 202. In various examples, the oxygen sensor may be positioned at the hot collector box 236 (shown), the cold collector box 244, the variable-speed draft inducer blower 206, or the designated venting environment through which the combustion flow path exits the modulating gas furnace.

The temperature 214C sensor may be configured to measure the temperature inside the combustion system 202. The temperature sensor may be positioned proximate the intake manifold 222, proximate the heat exchanger tubes 240, proximate a bend in the heat exchanger tubes (shown), or proximate the second end 234 of the heat exchanger assembly 210 coupled to the hot collector box 236. In some examples, the modulating gas furnace may include multiple temperature sensors, further including a temperature sensor located proximate the inlet airflow 248 received by the variable-speed circulating air blower 212.

In some example implementations, the control circuitry of the modulating gas furnace may communicate with and/or otherwise affect control over the modulating gas valve 208, igniter 230 of the burner assembly 204, the variable-speed draft inducer blower 206, and/or the variable-speed circulating air blower 212. The control circuitry may control the variable-speed draft inducer blower to provide an adequate gas flow along combustion flow path 246 for a desired firing rate through burner assembly.

Returning to FIG. 1, according to example implementations of the present disclosure, the modulating gas furnace 100 may be configured to control combustion based on measurements of one or more operating conditions from the one or more sensors 114 to maintain desirable furnace efficiency and emissions during operation. In some examples, the control circuitry 116 of the modulating gas furnace 100 is configured to receive an indication of a firing rate setpoint for the burner assembly 104 of the combustion system 102. The control circuitry is configured to determine an air-to-fuel ratio setpoint and a combustion system pressure setpoint from the firing rate setpoint. In some examples, the control circuitry is configured to apply the firing rate setpoint to a first continuous function and a second continuous function that map the firing rate setpoint to an air-to-fuel ratio setpoint and a combustion system pressure setpoint. The first continuous function in particular mapping firing rate to combustion system pressure.

The control circuitry 116 is configured to set the variable-speed draft inducer blower 106 to drive to the combustion system pressure setpoint, and control the modulating gas valve 108 during combustion in the combustion system 102. In some examples, the modulating gas valve is fully closed at startup, before combustion in the combustion system (before ignition), and the control circuitry sets the modulating gas valve to a gas valve position after startup and during combustion. In some examples, the control circuitry is configured to control the modulating gas valve continuously during combustion in the combustion system.

In examples in which the one or more sensors 114 include the pressure sensor 114A, the control circuitry 116 is configured to obtain a combustion system pressure measurement from the pressure sensor. The control circuitry, then, is configured to set the modulating gas valve 108 to a gas valve position based on the system pressure measurement. The control circuitry may set the modulating gas valve in any of a number of different manners. In some examples, the control circuitry is configured to apply the combustion system pressure measurement to an inverse of the first continuous function that outputs an adjusted firing rate for the combustion system pressure measurement. And the control circuitry is configured to apply the adjusted firing rate to a third continuous function that maps the firing rate to gas valve position, and outputs a gas valve position for the adjusted firing rate, and set the modulating gas valve 108 to the gas valve position.

In some examples, the first continuous function, the second continuous function and the third continuous function are defined by equations. These equations include terms determined during calibration of the modulating gas furnace at calibration points with calibration firing rates that define endpoints of firing rate ranges for which the terms have respective values. In some of these examples, the control circuitry 116 is configured to apply the firing rate setpoint to the first continuous function and the second continuous function, and apply the adjusted firing rate to the third continuous function, in which the terms are set to the respective values for one of the firing rate ranges that includes the firing rate setpoint.

To further illustrate example implementations in which the one or more sensors 114 include the pressure sensor 114A, consider an example in which modulating gas furnace 100 is calibrated at a gas stand around multiple calibration points. These calibration points may include calibration firing rates such as a high firing rate and a low firing rate that in some examples may correspond to respectively the furnace's maximum output capacity and minimum output capacity. The high firing rate and the low firing rate may define endpoints of a firing rate range. In some examples, the calibration points may also include at least one intermediate firing rate between the high and low firing rate, which may increase accuracy of the calibration over an entire operating range of the modulating gas furnace. In these examples, the low firing rate to the intermediate firing rate may define endpoints of one firing rate range, and the intermediate firing rate to the high firing rate may define endpoints of another firing rate range.

Calibration of the modulating gas furnace 100 at each of the calibration points may include startup of the modulating gas furnace during or after which the modulating gas valve 108 may be set to an appropriate gas valve position, and the variable-speed circulating air blower 112 may be set to an appropriate airflow rate. After startup and during combustion, the gas valve position of the modulating gas valve may be adjusted to achieve a calibration firing rate (e.g., 40% at the low output capacity). The combustion system pressure may be adjusted to meet a target carbon dioxide concentration, with an increase or a decrease in combustion system pressure leading to respectively a decrease or an increase in carbon dioxide concentration. Likewise, the airflow rate from the variable-speed circulating air blower may be adjusted to meet a target temperature rise, with an increase or a decrease in airflow rate leading to respectively a decrease or an increase in temperature rise.

After the modulating gas furnace 100 reaches steady-state operation at the calibration firing rate, and with the target carbon dioxide concentration and target temperature rise, various operating conditions of the modulating furnace for the calibration point may be measured and recorded to the control circuitry 116. Examples of these operating conditions include carbon dioxide concentration, oxygen concentration, temperature (calibrated temperature) inside the combustion system 102, temperature rise, combustion system pressure, gas valve position of the modulating gas valve 108, airflow rate of the variable-speed circulating air blower 112, and the like. The calibration may repeat for others of the calibration points, with the operating conditions for each of the calibration points measured and recorded to the control circuitry.

In some examples, the carbon dioxide concentration measurement may be converted to an air-to-fuel ratio at each of the recorded calibration points, such as according to the following:

$$\lambda = \alpha + \frac{\beta}{\mathrm{CO2\%}} \tag{1}$$

In equation (1), $\lambda$ and CO2% represent respectively the air-to-fuel ratio and carbon dioxide concentration. Also in the above, $\alpha$ and $\beta$ are constants that may be set as follows for examples in which the fuel is natural gas or propane. For natural gas, the constants may be set to: $\alpha$=0.09194 and $\beta$=10.96; and for propane, the constants may be set to: $\alpha$=0.08410 and $\beta$=12.60.

In some examples, the oxygen concentration measurement may be converted to the air-to-fuel ratio at each of the recorded calibration points. In these examples, the oxygen concentration after combustion (O2%) is compared with the oxygen concentration in the ambient or pre-combustion air (AO2%), which may be close to 20.9%, according to the following:

$$\lambda = \frac{A\mathrm{O2\%}}{A\mathrm{O2\%} - \mathrm{O2\%}} \tag{2}$$

In equation (2), O2% represents the oxygen concentration used to convert the air-to-fuel ratio at each of the recorded calibration points.

The air-to-fuel ratio correlation may be assumed to be linear to the square root of system to manifold pressure ratio:

$$\lambda = A \times R + B \tag{3}$$

$$R = \sqrt{\frac{P_{system}}{P_{manifold}}} \tag{4}$$

And the firing rate may be assumed to be linearly correlated to the square root of the manifold pressure, which may be used to redefine the ratio R as:

$$R = \frac{\sqrt{P_{system}}}{FiringRate} \tag{5}$$

For pairs of consecutive calibration points, the terms A and B may be solved directly to interpolate between them. For a calibration point, the calibration firing rate, combustion system pressure and gas valve position are given or measured, and the air-to-fuel ratio may be determined according to equation (1) from the carbon dioxide concentration that may be measured, or according to equation (2) from the oxygen concentration that may be measured. For calibration point n, these variables may be represented as respectively $\mathrm{FiringRate}_{[n]}$, $P_{system[n]}$, $\mathrm{ValvePosition}_{[n]}$ and $\lambda_{[n]}$. In some examples, n=1 and n=2 may be a pair of consecutive calibration points that correspond to respectively the low firing rate and the high firing rate. In other examples, n=1 and n=2 may be a pair of consecutive calibration points that correspond to respectively the low firing rate and the intermediate firing rate; and n=2 and n=3 may be another pair of consecutive calibration points that correspond to respectively the intermediate firing rate and the high firing rate.

For calibration points n and n+1, the ratio R may be determined according to equation (5) as follows:

$$R_{[n]} = \frac{\sqrt{P_{system\ [n]}}}{FiringRate_{[n]}},\ R_{[n+1]} = \frac{\sqrt{P_{system\ [n+1]}}}{FiringRate_{[2n+1]}}$$

The air-to-fuel ratio $\lambda$ may also be determined according to equation (4) as follows:

$$\lambda_{[n]} = A \times R_{[n]} + B, \lambda_{[n+1]} = A \times R_{[n+1]} + B$$

The terms A and B may be determined from the above as follows:

$$B = \left(\frac{\lambda_{[n]} R_{[n+1]}}{R_{[n]}} - \lambda_{[n+1]}\right) \Big/ \left(\frac{R_{[n+1]}}{R_{[n]}} - 1\right) \tag{6}$$

$$A = \frac{\lambda_{[n]} - B}{R_{[n+1]}} \tag{7}$$

The terms A and B may be determined for each pair of consecutive calibration points. In examples including calibration points for a low firing rate and high firing rate, this may include determining terms A and B for n=1 and n=2 that correspond to respectively the low firing rate and the high firing rate (defining endpoints of a firing rate range). In examples further including an intermediate firing rate, values of the terms A and B may be determined for n=1 and n=2 that correspond to respectively the low firing rate and the intermediate firing rate (defining endpoints of one firing rate range), and for n=2 and n=3 that correspond to respectively the intermediate firing rate and the high firing rate (defining endpoints of another firing rate range).

The control circuitry 116 may receive an indication of a firing rate setpoint ($FiringRate_{setpoint}$), such as from a thermostat. The variables $FiringRate_{[n]}$, $P_{system[n]}$, $ValvePosition_{[n]}$ and $\lambda_{[n]}$ are given, measured or determined for the pair of consecutive calibration points (e.g., n=1, n=2) in a range of firing rates that includes the firing rate setpoint. The control circuitry may apply the firing rate setpoint to first and second continuous functions that map the firing rate setpoint to an air-to-fuel ratio setpoint ($\lambda_{setpoint}$) and a combustion system pressure setpoint ($P_{system\ Setpoint}$). In particular, for example, one continuous function (in some examples, the second continuous function) maps firing rate to air-to-fuel ratio, such as according to a linear interpolation:

$$\lambda = \left(\frac{FiringRate - FiringRate_{[n]}}{FiringRate_{[n+1]} - FiringRate_{[n]}}\right) \times (\lambda_{[n+1]} - \lambda_{[n]}) + \lambda_{[n]} \tag{8}$$

And given the firing rate setpoint, the continuous function maps the firing rate setpoint to the air-to-fuel ratio setpoint.

A setpoint ratio $R_{setpoint}$ may be as determined using $\lambda_{setpoint}$, and the appropriate A and B value set for the range of firing rates including the firing rate setpoint, such as according to a rearrangement of equation (3):

$$R_{setpoint} = \frac{\lambda_{setpoint} - B}{A} \tag{9}$$

A rearrangement of equation (5) may be used to map firing rate to combustion system pressure as follows:

$$P_{system} = (R \times \text{FiringRate})^2 \tag{10}$$

And given the firing rate setpoint, the function maps the firing rate setpoint to the combustion system pressure setpoint. This is another continuous function (in some examples, the first continuous function), which combining equations (3) and (10), may be restated in terms of λ, and the appropriate A and B value set:

$$P_{system} = \left(\left(\frac{\lambda - B}{A}\right) \times FiringRate\right)^2 \tag{11}$$

The above equation (11) is also a continuous function, which at times may be the first continuous function that maps firing rate to combustion system pressure.

The control circuitry 116 may obtain a combustion system pressure measurement ($P_{system\ measured}$) from the pressure sensor 114A, which may be used to determine a gas valve position of the modulating gas valve 108. In some examples, the combustion system pressure measurement may be applied to an inverse of the first continuous function that outputs an adjusted firing rate (AdjustedFiringRate), such as according to the following inverse of equation (10) in which $P_{system}$, R and FiringRate may set to respectively $P_{system\ measured}$, $R_{setpoint}$ and AdjustedFiringRate:

$$AdjustedFiringRate = \frac{\sqrt{P_{system\ measured}}}{R_{setpoint}} \tag{12}$$

Restated according to equation (11), and using $\lambda_{setpoint}$, the adjusted firing rate may be determined as follows:

$$AdjustedFiringRate = \frac{A \times \sqrt{P_{system\ measured}}}{\lambda_{setpoint} - B} \tag{13}$$

The control circuitry 116 may apply the adjusted firing rate to a third continuous function that maps the firing rate to gas valve position, and outputs a gas valve position (ValvePosition) for the adjusted firing rate. One example of the third continuous function is an interpolation using the firing rates and valve positions for the pair of consecutive calibration points (e.g., n=1, n=2) in that include the adjusted firing rate:

$$ValvePosition = \left(\frac{AdjustedFiringRate - FiringRate_{[n]}}{FiringRate_{[n+1]} - FiringRate_{[n]}}\right) \times (ValvePosition_{[n+1]} - ValvePosition_{[n]}) + ValvePosition_{[n]} \tag{14}$$

The control circuitry may then set the modulating gas valve 108 to the gas valve position.

In some examples in which the one or more sensors 114 include the oxygen sensor 114B, the control circuitry 116 is configured to obtain an oxygen concentration measurement from the oxygen sensor. In some of these examples, the control circuitry is configured to determine an air-to-fuel ratio measurement from the oxygen concentration measurement. The control circuitry is configured to determine a gas valve position adjustment based on a difference between the air-to-fuel ratio setpoint and the air-to-fuel ratio measurement, and modify the gas valve position with the gas valve position adjustment. In some examples, the control circuitry is configured to bound the gas valve position adjustment to a maximum adjustment.

Further to the above in which the one or more sensors 114 include the oxygen sensor 114B, and the control circuitry 116 is configured to obtain an oxygen concentration measurement after combustion, the control circuitry may determine an air-to-fuel ratio measurement ($\lambda_{measured}$) from the oxygen concentration measurement ($O2\%_{measured}$) compared with the oxygen concentration in the ambient or pre-combustion air (AO2%), which may be close to 20.9%, according to the above equation (2):

$$\lambda_{measured} = \frac{AO2\%}{AO2\% - O2\%_{measured}}$$

The measured air-to-fuel ratio may be compared to the air-to-fuel ratio setpoint, and the difference may be taken as an error ($\lambda_{error}$) used to drive a bounded proportional-integral (PI) loop:

$$\lambda_{error} = \lambda_{setpoint} - \lambda_{measured}$$

$$\text{ProportionalTerm} = K_P \times \lambda_{error}$$

$$\text{IntegralTerm} = \text{IntegralTerm}_{z^{-1}} + K_I \times \lambda_{error}$$

$$PI_{output} = \text{IntegralTerm} + \text{ProportionalTerm}$$

In some examples, the PI loop output may be saturated to prevent a gas valve position adjustment considered excessive, and the control circuitry 116 may thereby bound the gas valve position adjustment to a maximum adjustment. This may be accomplished using an integral recalculation:

if($PI_{output}$>MaxModification)

IntegralTerm=MaxModification−ProportionalTerm else if($PI_{output}$<−MaxModification)

IntegralTerm=−MaxModification−ProportionalTerm end

In some further examples, to prevent windup, the integral term may also be saturated and the PI loop output recalculated:

IntegralTerm=max(IntegralTerm,−MaxModification)

IntegralTerm=min(IntegralTerm,MaxModification)

$PI_{Output}$=IntegralTerm+ProportionalTerm

The PI loop output ($PI_{output}$) may be taken as a gas valve position adjustment determined based on the difference between $\lambda_{setpoint}$ and $\lambda_{measured}$, and control circuitry 116 may use the gas valve position adjustment to adjust the gas valve position of the modulating gas valve 108:

$$\text{ValvePosition}=\text{ValvePosition}+PI_{output} \tag{15}$$

In some examples in which the one or more sensors 114 include the temperature sensor 114C, at least the first continuous function and the second continuous function are defined by equations that include terms determined during calibration of the modulating gas furnace 100 at calibration points with calibration firing rates and calibrated temperatures. In some of these examples, the control circuitry 116 is configured to detect a steady-state operation of the modulating gas furnace at the firing rate setpoint or the adjusted firing rate. The control circuitry is configured to obtain a temperature measurement from the temperature sensor. The control circuitry is configured to determine a gas valve position adjustment based on a difference between at least one of the calibrated temperatures and the temperature measurement, and modify the gas valve position with the gas valve position adjustment. In some examples, control circuitry is configured to bound the gas valve position adjustment to a maximum adjustment.

In some further examples, the control circuitry 116 is configured to detect the steady-state operation of the modulating gas furnace 100 at the firing rate setpoint or the adjusted firing rate that corresponds to a calibration firing rate for a calibration point, or that is between firing rates for consecutive calibration points. In some examples in which the firing rate setpoint/the adjusted firing rate corresponds to a calibration firing rate, the control circuitry is configured to determine the gas valve position adjustment based on a difference between a calibrated temperature for the calibration point, and the temperature measurement. And in some examples in which the firing rate setpoint/the adjusted firing rate is between firing rates for consecutive calibration points, the control circuitry is configured to determine the gas valve position adjustment based on differences between the calibrated temperatures for the consecutive calibration points, and the temperature measurement.

To further illustrate use of the temperature sensor 114C, consider the modulating gas furnace 100 operating at or near the calibration firing rate of a calibration point for a sufficient time to reach steady-state operation. The control circuitry 116 may be configured to obtain a temperature measurement from the temperature sensor, and use the temperature measurement and the calibrated temperature to adjust the gas valve position of the modulating gas valve 108. The adjustment may be made to target the calibrated temperature at the calibration point, which may allow the control circuitry to account for line pressure and heating value variation and drive the furnace closer to the calibrated conditions.

In some examples, the calibration point may depend on the target temperature rise for some types of temperature sensor 114C (e.g., thermistor), or on the calibration firing rate for other types of temperature sensor (e.g., infrared sensor). The time to steady-state operation may also differ, with some types of temperature sensor (e.g., thermistor) taking minutes, with other types of temperature sensor (e.g., infrared sensor) taking tens of seconds.

The modulating gas furnace 100 may more likely have repeated steady-state operation at the low and high firing rates than other firing rates, so in some examples, the calibrated temperatures (and corresponding valve adjustments) may be set at those calibration firing rates. Additional calibrated temperatures may be set at other calibration firing rates, or the valve adjustment may be determined according to another continuous function such as one that linearly interpolates the valve adjustment from the calibrated temperatures at the calibration firing rates.

According to some examples, the valve adjustment may be determined from an independent PI loop at each calibration point. The PI loop may use the difference between the calibrated temperature and the temperature measurement for feedback. For a calibration point n, the PI loop output may be determined as follows:

$$\text{Temp}[n]_{error}=\text{Temp}[n]_{setpoint}-\text{Temp}[n]_{measured}$$

$$\text{ProportionalTerm}[n]=K_P\times\text{Temp}[n]_{error}$$

$$\text{IntegralTerm}[n]=\text{IntegralTerm}[n]_{z^{-1}}+K_I\times\text{Temp}[n]_{error}$$

$$PI[n]_{output}=\text{IntegralTerm}[n]+\text{ProportionalTerm}[n]$$

Similar to above, in some examples, the PI loop output may be saturated to prevent a gas valve position adjustment considered excessive, and the control circuitry 116 may thereby bound the gas valve position adjustment to a maximum adjustment. This may be accomplished using an integral recalculation:

if($PI[n]_{Output}$>MaxModification)

IntegralTerm[$n$]=MaxModification−ProportionalTerm[$n$]

else if($PI[n]_{Output}$<−MaxModification)

IntegralTerm[$n$]=−MaxModification−ProportionalTerm[$n$]

end

In some further examples, to prevent windup, the integral term may also be saturated and the PI loop output recalculated:

IntegralTerm[$n$]=max(IntegralTerm[$n$],−MaxModification)

IntegralTerm[$n$]=min(IntegralTerm[$n$],MaxModification)

$PI[n]_{Output}$=IntegralTerm[$n$]+ProportionalTerm[$n$]

At a position between the two calibration points n−1 and n, the gas valve position adjustment may be determined according to a linearly interpolated PI loop adjustment output:

$$\text{Adjustement} = \left(\frac{FiringRate - FiringRate_{[n-1]}}{FiringRate_{[n]} - FiringRate_{[n-1]}}\right) \times (PI[n]_{Output} - PI[n-1]_{Output}) + PI[n-1]_{Output} \quad (16)$$

In equation (16), in some examples, the FiringRate is current firing rate, which may be the firing rate setpoint or the adjusted firing rate. In this case, the PI[n] and PI[n−1] terms may be fixed and not update until the modulating gas furnace 100 goes back to steady-state operation at one of the calibration points. And as before, the control circuitry 116 may use the gas valve position adjustment to adjust the gas valve position of the modulating gas valve 108:

$$\text{ValvePosition}=\text{ValvePosition}+\text{Adjustment} \quad (17)$$

In some examples, the control circuitry 116 is configured to receive an indication of a selected temperature rise desired for the conditioned airflow created by the variable-speed circulating air blower 112, and in the selected temperature rise is a desired difference in temperature between air entering and exiting the heat exchanger assembly 110. The indication of the selected temperature rise may be received in a number of different manners, such as by an installer, through the thermostat or another user-input means (e.g., connected mobile app). The control circuitry is configured to apply the firing rate setpoint and the selected temperature rise to a fourth continuous function that maps firing rate and temperature rise to airflow rate, and that outputs an airflow rate setpoint for the firing rate setpoint and the selected temperature rise. And the control circuitry is configured to set the variable-speed circulating air blower 112 to drive to the airflow rate setpoint.

More particularly, in some examples, the temperature rise (TempRise) may be estimated using power output (Power) of the combustion system 102, and assuming an accurate airflow rate (FlowRate) of the variable-speed circulating air blower 112 and ideal mixing:

$$TempRise = \frac{\text{Power}}{FlowRate \times \text{Density} \times Cv} \quad (18)$$

In equation (18), Cv represents the specific heat of the inlet air. And the power output may be estimated as:

$$\text{Power}=\text{RatedCap}\times\text{Efficiency}\times\text{FiringRate} \quad (19)$$

In equation (19), RatedCap and Efficiency represent respectively a rated capacity and an efficiency of the modulating gas furnace 100. And from equations (18) and (19), airflow rate may be expressed as a function of a selected temperature rise desired for the conditioned airflow created by the variable-speed circulating air blower:

$$FlowRate = \frac{RatedCap \times FiringRate \times \text{Efficiency}}{TempRise \times Cv \times \text{Density}} \quad (20)$$

In equation (20), Density represents air density of the airflow created by the variable-speed circulating air blower.

Given a calibration firing rate, an airflow rate and a temperature rise at multiple calibration points, the efficiency of the modulating gas furnace 100 may be determined at each calibration point n:

$$\text{Efficiency}_{[n]} = \frac{RatedCap \times FiringRate_{[n]}}{FlowRate_{[n]} \times TempRise_{[n]} \times Cv \times \text{Density}} \quad (21)$$

The efficiency between two calibration points may be linearly interpolated with firing rate:

$$\text{Efficiency} = \left(\frac{FiringRate - FiringRate_{[n]}}{FiringRate_{[n+1]} - FiringRate_{[n]}}\right) \times (\text{Efficiency}_{[n+1]} - \text{Efficiency}_{[n]}) + \text{Efficiency}_{[n]} \quad (22)$$

Applying the firing rate setpoint to equation (22), the control circuitry 116 may determine an efficiency setpoint ($\text{Efficiency}_{setpoint}$).

From the efficiency setpoint, an airflow rate setpoint ($\text{FlowRate}_{setpoint}$) to achieve the selected temperature rise may be determined from equation (20) as follows:

$$FlowRate_{setpoint} = \frac{RatedCap \times FiringRate_{setpoint} \times \text{Efficiency}_{setpoint}}{TempRise \times Cv \times \text{Density}} \quad (23)$$

Equation (20) is a continuous function (in some examples, the fourth continuous function) that maps firing rate and temperature rise to airflow rate, and as expressed in equation (23), outputs the airflow rate setpoint for the firing rate setpoint and the selected temperature rise.

In equation (23), the Cv and Density terms may be determined at the measured indoor/return temperature condition, if available; or the terms may be assumed to be at reasonable indoor conditions during heating season. At 70° F. and 40% relative humidity, for example, values for the Cv and Density terms may be substituted into equation (23), which may simplify to:

$$FlowRate_{Setpoint} = 917.67 \times \left(\frac{RatedCap \times FiringRate_{setpoint} \times \text{Efficiency}_{Setpoint}}{TempRise}\right) \quad (24)$$

In equation (24), RatedCap is in kBtu, $\text{FlowRate}_{setpoint}$ is in CFM, and TempRise is in degrees Fahrenheit. And again, the control circuitry 116 is configured to set the variable-speed circulating air blower 112 to drive to the airflow rate setpoint, and thereby achieve the selected temperature rise.

FIGS. 3A, 3B, 3C and 3D are flowcharts illustrating various operations in a method 300 of controlling combustion in a modulating gas furnace, according to some example implementations. Again, the modulating gas furnace includes a variable-speed draft inducer blower configured to move air through a combustion system that includes a burner assembly, a modulating gas valve configured to modulate an amount of fuel delivered to the burner assembly, and a pressure sensor configured to measure combustion system pressure. As shown at block 302 of FIG. 3A, the method includes receiving an indication of a firing rate setpoint for the burner assembly, such as from a thermostat. The method includes applying the firing rate setpoint to a first continuous function and a second continuous function that map the firing rate setpoint to an air-to-fuel ratio setpoint and a combustion system pressure setpoint, the first continuous function mapping firing rate to combustion system pressure, as shown at block 304. The method includes setting the variable-speed draft inducer blower to drive to the combustion system pressure setpoint, and controlling the modulating gas valve during combustion in the combustion system, as shown at blocks 306 and 308.

In some examples, controlling the modulating gas valve at block 308 includes obtaining a combustion system pressure measurement from the pressure sensor, and applying the combustion system pressure measurement to an inverse of the first continuous function that outputs an adjusted firing rate for the combustion system pressure measurement, as shown at blocks 310 and 312. The adjusted firing rate is applied to a third continuous function that maps the firing rate to gas valve position, and outputs a gas valve position for the adjusted firing rate, as shown at block 314. The modulating gas valve is then set to the gas valve position, as shown at block 316. And in some examples, control of the modulating gas valve is performed continuously during combustion in the combustion system.

In some examples, the first continuous function, the second continuous function and the third continuous function are defined by equations that include terms determined during calibration of the modulating gas furnace at calibration points with calibration firing rates that define endpoints of firing rate ranges for which the terms have respective values. In some of these examples, the firing rate setpoint is applied to the first continuous function and the second continuous function at block 304, and the adjusted firing rate is applied to the third continuous function at block 314, in which the terms are set to the respective values for one of the firing rate ranges that includes the firing rate setpoint.

Figure 3A:
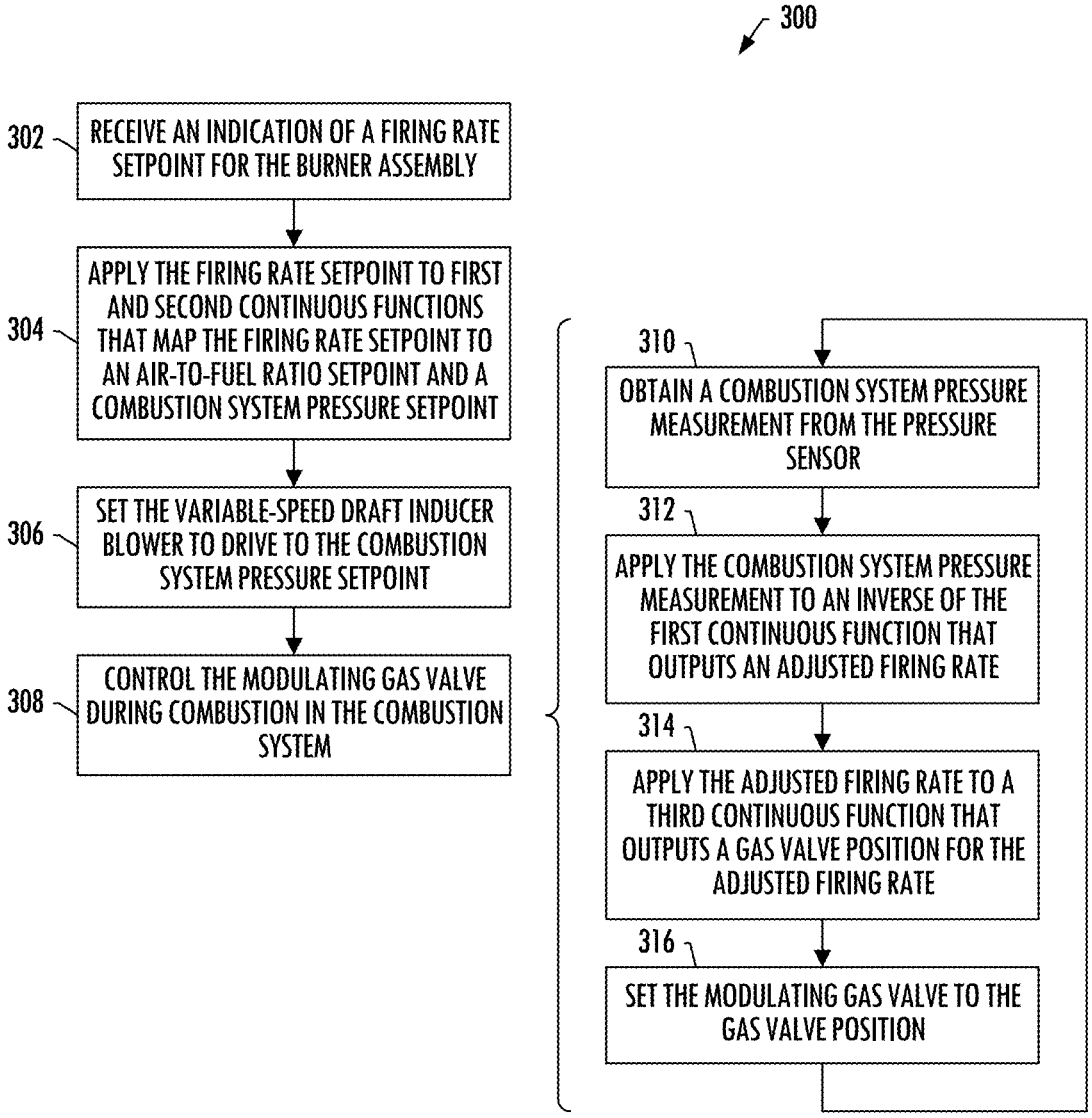
FIGS. 3A, 3B, 3C and 3D are flowcharts illustrating various operations in a method of controlling combustion in a modulating gas furnace, according to some example implementations.
Figure 3B:
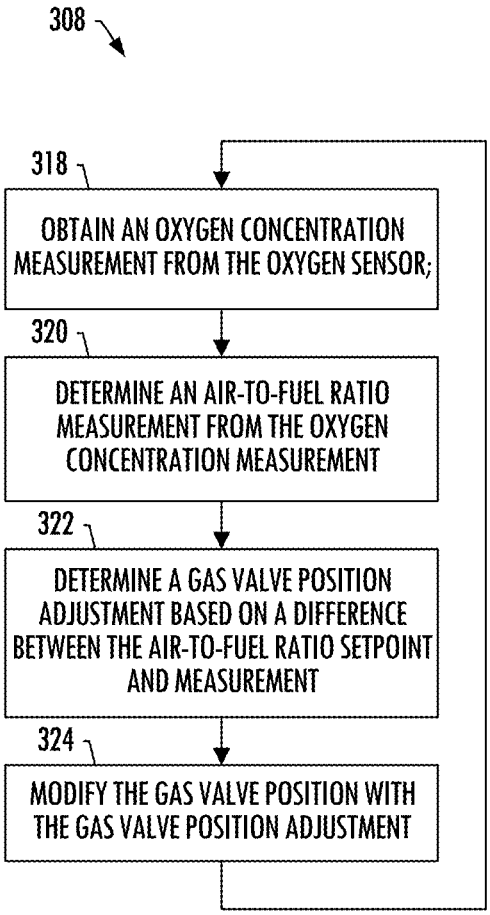

Referring now to FIG. 3B, in some examples, the modulating gas furnace further includes an oxygen sensor configured to measure oxygen concentration in the air moved through the combustion system. In some of these examples, controlling the modulating gas valve at block 308 further includes obtaining an oxygen concentration measurement from the oxygen sensor, and determining an air-to-fuel ratio measurement from the oxygen concentration measurement, as shown at blocks 318 and 320. A gas valve position adjustment is determined based on a difference between the air-to-fuel ratio setpoint and the air-to-fuel ratio measurement, and the gas valve position is modified with the gas valve position adjustment, as shown at blocks 322 and 324. In some examples, determining the gas valve position adjustment includes bounding the gas valve position adjustment to a maximum adjustment.

Figure 3C:
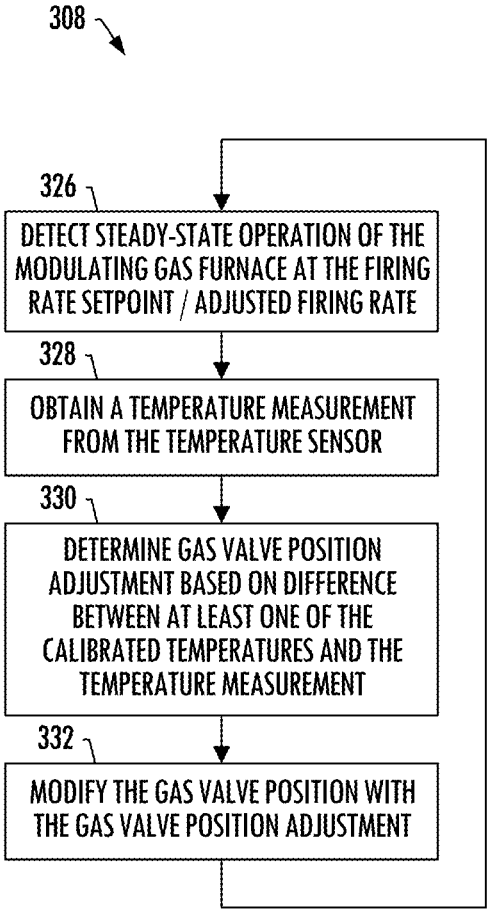

Turning to FIG. 3C, in some examples, the modulating gas furnace further includes a temperature sensor configured to measure temperature inside the combustion system. In some of these examples, at least the first continuous function and the second continuous function are defined by equations that include terms determined during calibration of the modulating gas furnace at calibration points with calibration firing rates and calibrated temperatures. Also in some of these examples, controlling the modulating gas valve at block 308 further includes detecting a steady-state operation of the modulating gas furnace at the firing rate setpoint or the adjusted firing rate, and obtaining a temperature measurement from the temperature sensor, as shown at blocks 326 and 328. A gas valve position adjustment is determined based on a difference between at least one of the calibrated temperatures and the temperature measurement, and the gas valve position is modified with the gas valve position adjustment, as shown at blocks 330 and 332. In some examples, determining the gas valve position adjustment includes bounding the gas valve position adjustment to a maximum adjustment.

In some examples, the steady-state operation of the modulating gas furnace is detected at block 326 at the firing rate setpoint or the adjusted firing rate that corresponds to a calibration firing rate for a calibration point, or that is between firing rates for consecutive calibration points. In some examples in which the firing rate setpoint/the adjusted firing rate corresponds to a calibration firing rate, the gas valve position adjustment is determined at block 330 based on a difference between a calibrated temperature for the calibration point, and the temperature measurement. And in some examples in which the firing rate setpoint/the adjusted firing rate is between firing rates for consecutive calibration points, the gas valve position adjustment is determined based on differences between the calibrated temperatures for the consecutive calibration points, and the temperature measurement.

Figure 3D:
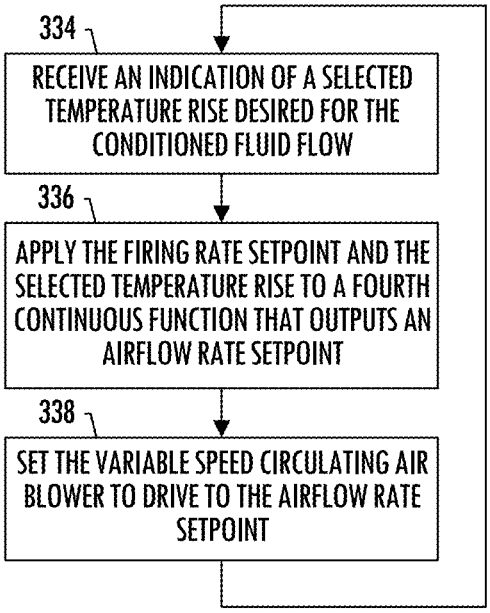

Referring to FIG. 3D, in some examples, the modulating gas furnace further includes with a heat exchanger assembly, and a variable-speed circulating air blower configured to create an airflow to which heat from the heat exchanger assembly is transferred to create a conditioned airflow. In some of these examples, the method 300 further includes receiving an indication of a selected temperature rise desired for the conditioned airflow, and in the selected temperature rise is a desired difference in temperature between air entering and exiting the heat exchanger assembly, as shown at block 334. The firing rate setpoint and the selected temperature rise are applied to a fourth continuous function that maps firing rate and temperature rise to airflow rate, and that outputs an airflow rate setpoint for the firing rate setpoint and the selected temperature rise, as shown at block 336. And the variable-speed circulating air blower is set to drive to the airflow rate setpoint, as shown at block 338.

According to example implementations of the present disclosure, the control circuitry 116 (and as a more particular example, control circuitry 216) may be implemented by various means. Means for implementing the control circuitry may include hardware, alone or under direction of one or more computer programs from a computer-readable storage medium. In some examples, the control circuitry is formed of one or more circuit boards. The control circuitry may be centrally located or distributed throughout the modulating gas furnace 100. For example, the control circuitry may be formed of distinct circuit boards including a circuit board positioned on a panel of the modulating gas furnace, and one or more circuit boards positioned at or within either or both of the variable-speed draft inducer blower 106, the variable-speed circulating air blower 212 (e.g., at blower motor 254 of variable-speed circulating air blower 212).

Figure 4:
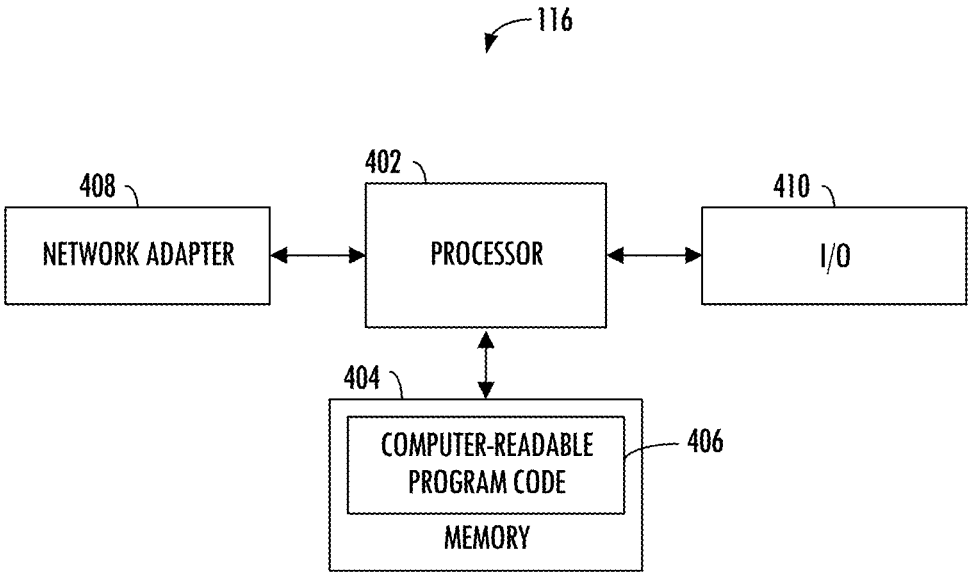
FIG. 4 illustrates control circuitry according to some example implementations.

FIG. 4 illustrates the control circuitry 116 according to some example implementations of the present disclosure. The control circuitry may include one or more of each of a number of components such as, for example, a processor 402 connected to a memory 404. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 402 may be a number of processors, a multi-core processor or some other type of processor, depending on the particular implementation.

The processor 402 may be configured to execute computer programs such as computer-readable program code 406, which may be stored onboard the processor or otherwise stored in the memory 404. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 404 is generally any piece of computer hardware capable of storing information such as, for example, data, computer-readable program code 406 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 402, causes the control circuitry 116 to perform various operations as described herein, some of which may in turn cause the modulating gas furnace 100 to perform various operations.

In addition to the memory 404, the processor 402 may also be connected to one or more peripherals such as a network adapter 408, one or more input/output (I/O) devices 410 or the like. The network adapter is a hardware component configured to connect the control circuitry 116 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A modulating gas furnace comprising:

a combustion system that includes a burner assembly;

a variable-speed draft inducer blower configured to move air through the combustion system;

a modulating gas valve configured to modulate an amount of fuel delivered to the burner assembly;

a pressure sensor configured to measure combustion system pressure; and control circuitry operably coupled to the variable-speed draft inducer blower, the modulating gas valve and the pressure sensor, the control circuitry configured to at least:

receive an indication of a firing rate setpoint for the burner assembly;

apply the firing rate setpoint to a first continuous function and a second continuous function that map the firing rate setpoint to an air-to-fuel ratio setpoint and a combustion system pressure setpoint, the first continuous function mapping firing rate to combustion system pressure;

set the variable-speed draft inducer blower to drive to the combustion system pressure setpoint; and control the modulating gas valve during combustion in the combustion system, including the control circuitry configured to at least:

obtain a combustion system pressure measurement from the pressure sensor;

apply the combustion system pressure measurement to an inverse of the first continuous function that outputs an adjusted firing rate for the combustion system pressure measurement;

apply the adjusted firing rate to a third continuous function that maps the firing rate to gas valve position, and outputs a gas valve position for the adjusted firing rate; and set the modulating gas valve to the gas valve position.

2. The modulating gas furnace of claim 1, wherein the control circuitry is configured to control the modulating gas valve continuously during combustion in the combustion system.

3. The modulating gas furnace of claim 1, wherein the first continuous function, the second continuous function and the third continuous function are defined by equations that include terms determined during calibration of the modulating gas furnace at calibration points with calibration firing rates that define endpoints of firing rate ranges for which the terms have respective values, and wherein the control circuitry is configured to apply the firing rate setpoint to the first continuous function and the second continuous function, and apply the adjusted firing rate to the third continuous function, in which the terms are set to the respective values for one of the firing rate ranges that includes the firing rate setpoint.

4. The modulating gas furnace of claim 1, further comprising an oxygen sensor configured to measure oxygen concentration in the air moved through the combustion system, and wherein the control circuitry configured to control the modulating gas valve further includes the control circuitry configured to at least:

obtain an oxygen concentration measurement from the oxygen sensor;

determine an air-to-fuel ratio measurement from the oxygen concentration measurement;

determine a gas valve position adjustment based on a difference between the air-to-fuel ratio setpoint and the air-to-fuel ratio measurement; and modify the gas valve position with the gas valve position adjustment.

5. The modulating gas furnace of claim 4, wherein the control circuitry configured to determine the gas valve position adjustment includes the control circuitry configured to bound the gas valve position adjustment to a maximum adjustment.

6. The modulating gas furnace of claim 1, further comprising a temperature sensor configured to measure temperature inside the combustion system, and wherein at least the first continuous function and the second continuous function are defined by equations that include terms determined during calibration of the modulating gas furnace at calibration points with calibration firing rates and calibrated temperatures, and the control circuitry configured to control the modulating gas valve further includes the control circuitry configured to at least:

detect a steady-state operation of the modulating gas furnace at the firing rate setpoint or the adjusted firing rate;

obtain a temperature measurement from the temperature sensor;

determine a gas valve position adjustment based on a difference between at least one of the calibrated temperatures and the temperature measurement; and modify the gas valve position with the gas valve position adjustment.

7. The modulating gas furnace of claim 6, wherein the control circuitry is configured to detect the steady-state operation of the modulating gas furnace at the firing rate setpoint or the adjusted firing rate that corresponds to a calibration firing rate for a calibration point, and the control circuitry is configured to determine the gas valve position adjustment based on a difference between a calibrated temperature for the calibration point, and the temperature measurement.

8. The modulating gas furnace of claim 6, wherein the control circuitry is configured to detect the steady-state operation of the modulating gas furnace at the firing rate setpoint or the adjusted firing rate that is between the calibration firing rates for consecutive calibration points, and the control circuitry is configured to determine the gas valve position adjustment based on differences between the calibrated temperatures for the consecutive calibration points, and the temperature measurement.

9. The modulating gas furnace of claim 6, wherein the control circuitry configured to determine the gas valve position adjustment includes the control circuitry configured to bound the gas valve position adjustment to a maximum adjustment.

10. The modulating gas furnace of claim 1 further comprising:

a heat exchanger assembly; and a variable-speed circulating air blower configured to create an airflow to which heat from the heat exchanger assembly is transferred to create a conditioned airflow, and wherein the control circuitry is further configured to at least:

receive an indication of a selected temperature rise desired for the conditioned airflow, and in the selected temperature rise is a desired difference in temperature between air entering and exiting the heat exchanger assembly;

apply the firing rate setpoint and the selected temperature rise to a fourth continuous function that maps firing rate and temperature rise to airflow rate, and that outputs an airflow rate setpoint for the firing rate setpoint and the selected temperature rise; and set the variable-speed circulating air blower to drive to the airflow rate setpoint.

11. A method of controlling combustion in a modulating gas furnace that includes a variable-speed draft inducer blower configured to move air through a combustion system that includes a burner assembly, a modulating gas valve configured to modulate an amount of fuel delivered to the burner assembly, and a pressure sensor configured to measure combustion system pressure, the method comprising:

receiving an indication of a firing rate setpoint for the burner assembly;

applying the firing rate setpoint to a first continuous function and a second continuous function that map the firing rate setpoint to an air-to-fuel ratio setpoint and a combustion system pressure setpoint, the first continuous function mapping firing rate to combustion system pressure;

setting the variable-speed draft inducer blower to drive to the combustion system pressure setpoint; and controlling the modulating gas valve during combustion in the combustion system, including:

obtaining a combustion system pressure measurement from the pressure sensor;

applying the combustion system pressure measurement to an inverse of the first continuous function that outputs an adjusted firing rate for the combustion system pressure measurement;

applying the adjusted firing rate to a third continuous function that maps the firing rate to gas valve position, and outputs a gas valve position for the adjusted firing rate; and setting the modulating gas valve to the gas valve position.

12. The method of claim 11, wherein control of the modulating gas valve is performed continuously during combustion in the combustion system.

13. The method of claim 11, wherein the first continuous function, the second continuous function and the third continuous function are defined by equations that include terms determined during calibration of the modulating gas furnace at calibration points with calibration firing rates that define endpoints of firing rate ranges for which the terms have respective values, and wherein the firing rate setpoint is applied to the first continuous function and the second continuous function, and the adjusted firing rate is applied to the third continuous function, in which the terms are set to the respective values for one of the firing rate ranges that includes the firing rate setpoint.

14. The method of claim 11, wherein the modulating gas furnace further includes an oxygen sensor configured to measure oxygen concentration in the air moved through the combustion system, and controlling the modulating gas valve further includes:

obtaining an oxygen concentration measurement from the oxygen sensor;

determining an air-to-fuel ratio measurement from the oxygen concentration measurement;

determining a gas valve position adjustment based on a difference between the air-to-fuel ratio setpoint and the air-to-fuel ratio measurement; and modifying the gas valve position with the gas valve position adjustment.

15. The method of claim 14, wherein determining the gas valve position adjustment includes bounding the gas valve position adjustment to a maximum adjustment.

16. The method of claim 11, wherein the modulating gas furnace further includes a temperature sensor configured to measure temperature inside the combustion system, at least the first continuous function and the second continuous function are defined by equations that include terms determined during calibration of the modulating gas furnace at calibration points with calibration firing rates and calibrated temperatures, and controlling the modulating gas valve further includes:

detecting a steady-state operation of the modulating gas furnace at the firing rate setpoint or the adjusted firing rate;

obtaining a temperature measurement from the temperature sensor;

determining a gas valve position adjustment based on a difference between at least one of the calibrated temperatures and the temperature measurement; and modifying the gas valve position with the gas valve position adjustment.

17. The method of claim 16, wherein the steady-state operation of the modulating gas furnace is detected at the firing rate setpoint or the adjusted firing rate that corresponds to a calibration firing rate for a calibration point, and the gas valve position adjustment is determined based on a difference between a calibrated temperature for the calibration point, and the temperature measurement.

18. The method of claim 16, wherein the steady-state operation of the modulating gas furnace is detected at the firing rate setpoint or the adjusted firing rate that is between the calibration firing rates for consecutive calibration points, and the gas valve position adjustment is determined based on differences between the calibrated temperatures for the consecutive calibration points, and the temperature measurement.

19. The method of claim 16, wherein determining the gas valve position adjustment includes bounding the gas valve position adjustment to a maximum adjustment.

20. The method of claim 11, wherein the modulating gas furnace further includes with a heat exchanger assembly, and a variable-speed circulating air blower configured to create an airflow to which heat from the heat exchanger assembly is transferred to create a conditioned airflow, and the method further comprises:

receiving an indication of a selected temperature rise desired for the conditioned airflow, and in the selected temperature rise is a desired difference in temperature between air entering and exiting the heat exchanger assembly;

applying the firing rate setpoint and the selected temperature rise to a fourth continuous function that maps firing rate and temperature rise to airflow rate, and that outputs an airflow rate setpoint for the firing rate setpoint and the selected temperature rise; and setting the variable-speed circulating air blower to drive to the airflow rate setpoint.

* * * * *